US005520308A

United States Patent [19]

Berg, Jr. et al.

[11] Patent Number: 5,520,308

[45] Date of Patent: May 28, 1996

[54] SEQUENTIAL DISPENSING OF TISSUES AND DISPENSER THEREFOR

[75] Inventors: Charles J. Berg, Jr., Cincinnati; Charles D. Cook, Fairfield, both of Ohio

[73] Assignee: The Procter & Gamble Company, Cincinnati, Ohio

[21] Appl. No.: 344,205

[22] Filed: Nov. 21, 1994

[51] Int. Cl.[6] ..... B65H 1/04

[52] U.S. Cl. ..... 221/50; 221/47; 221/48; 221/63; 221/305; 206/233; 206/494

[58] Field of Search ..... 221/33, 45, 47, 221/48, 50, 63, 303, 305, 312 C; 206/233, 494

[56] References Cited

U.S. PATENT DOCUMENTS

| | | | |
|---|---|---|---|
| 2,529,853 | 11/1950 | Taggart | 221/63 |
| 2,823,089 | 2/1958 | De Franco | 312/39 |
| 2,890,791 | 6/1959 | Wenzel | 206/57 |
| 3,007,605 | 11/1961 | Donovan | 221/47 |
| 3,021,002 | 2/1962 | Guyer | 206/57 |
| 3,160,337 | 12/1964 | Nelson | 225/32 |
| 3,172,563 | 3/1965 | Harwood | 221/48 |
| 3,239,097 | 3/1966 | Bates et al. | 221/48 |
| 3,266,666 | 8/1966 | Nelson | 221/48 |
| 3,369,699 | 2/1968 | Enloe et al. | 221/48 |
| 3,576,243 | 4/1971 | Trunick | 221/63 |
| 3,679,094 | 7/1972 | Nissen et al. | 221/50 |
| 3,679,095 | 7/1972 | Nissen et al. | 221/50 |
| 3,749,296 | 7/1973 | Harrison | 225/106 |
| 3,868,052 | 2/1975 | Rockefeller | 225/106 |
| 3,881,632 | 5/1975 | Early et al. | 221/50 |
| 3,973,695 | 8/1976 | Ames | 221/63 |
| 4,064,880 | 12/1977 | Logan | 221/47 X |
| 4,200,200 | 4/1980 | Hein, III et al. | 221/48 |
| 4,328,655 | 5/1982 | Spencer et al. | 53/439 |
| 4,328,907 | 5/1982 | Beard | 221/63 |
| 4,458,810 | 7/1984 | Mahoney | 206/210 |
| 4,574,952 | 3/1986 | Masui | 206/494 |
| 4,611,728 | 9/1986 | Compton et al. | 221/63 |
| 4,623,074 | 11/1986 | Dearwester | 221/48 |
| 4,653,666 | 3/1987 | Mertens | 221/45 |
| 4,674,634 | 6/1987 | Wilson | 221/45 X |
| 4,681,240 | 7/1987 | Wyant | 221/48 |
| 4,768,810 | 9/1988 | Mertens | 282/12 A |
| 4,859,518 | 8/1989 | Schutz | 428/126 |
| 4,863,064 | 9/1989 | Dailey, III | 221/48 |
| 4,895,746 | 1/1990 | Mertens | 428/40 |
| 4,921,127 | 5/1990 | Windorski | 221/45 |
| 4,927,064 | 5/1990 | Burgin | 221/63 X |
| 4,986,440 | 1/1991 | Windorski | 221/45 |
| 4,993,590 | 2/1991 | Windorski | 221/46 |
| 5,033,620 | 7/1991 | De Luca | 206/494 |
| 5,050,909 | 9/1991 | Mertens et al. | 283/81 |
| 5,067,628 | 11/1991 | Evenson | 221/52 |
| 5,080,254 | 1/1992 | Feer | 221/33 |
| 5,080,255 | 1/1992 | Windorski | 221/45 |
| 5,118,554 | 6/1992 | Chan et al. | 428/126 |
| 5,158,205 | 10/1992 | Bodziak et al. | 221/51 |
| 5,165,570 | 11/1992 | Windorski et al. | 221/46 |
| 5,167,346 | 12/1992 | Bodziak | 221/63 |
| 5,316,177 | 5/1994 | Boldt | 221/63 |
| 5,332,118 | 7/1994 | Muckenfuhs | 221/48 |
| 5,350,597 | 9/1994 | Pelley | 427/197 |
| 5,358,140 | 10/1994 | Pellegrino | 206/494 X |

FOREIGN PATENT DOCUMENTS

| | | | |
|---|---|---|---|
| 223262 | 5/1987 | European Pat. Off. | 221/63 X |
| 692378 | 4/1994 | Japan | 221/45 X |
| 60617 | 9/1947 | Netherlands | 221/47 X |
| 149028 | 3/1955 | Sweden | 206/233 X |

OTHER PUBLICATIONS

Package for 3M Post–it Note Pop Up Dispenser, Model C–330, Copyright 1991.

*Primary Examiner*—William E. Terrell
*Assistant Examiner*—Dean A. Reichard
*Attorney, Agent, or Firm*—Larry L. Huston; E. Kelly Linman; Jacobus C. Rasser

[57] ABSTRACT

A tissue package comprising a dispensing package and tissues. The dispensing package has a dispensing opening which constricts the tissues as they are withdrawn through the opening. The tissues are disposed in the dispensing package in a non-interleaved pattern. Each tissue is releasably attached to the adjacent tissue, so that upon withdrawal through the dispensing opening, the tissue pulls an adjacent tissue through the dispensing opening. Both reach-in and pop-up dispensing are possible.

12 Claims, 2 Drawing Sheets

SEQUENTIAL DISPENSING OF TISSUES AND DISPENSER THEREFOR

FIELD OF THE INVENTION

This invention relates to tissue packages, comprising a dispensing package and tissues in combination. More particularly, the present invention relates to sequential dispensing tissue packages, in which the tissues are provided in individual sheets and can "pop up" above the elevation of the top of the dispenser when the preceding sheet is removed.

BACKGROUND OF THE INVENTION

Tissues are well known in the art. Tissues, such as facial tissues, are commonly used for blowing one's nose, cleaning tasks, etc. Tissues can also be used as paper towels for wiping, cleanup tasks, etc. Tissues, and their packaging, must be inexpensive and disposable, to be widely consumer accepted. Tissues may be supplied dry, with lotion, or moistened. Such tissues are typically generally rectangular in shape and supplied in discrete sheets. Tissues are typically supplied in a generally parallelepipedly shaped box or dispenser. The dispenser has an opening, typically at the top, through which individual sheets are removed by the user.

Early tissue dispensers were of the "reach-in type." The user had to insert his or her fingers through the dispensing opening, grasp a tissue, and pull it out through the dispensing opening. Examples of reach-in dispensers, and improvements thereto, can be found in U.S. Pat. Nos. 3,021,002 issued Feb. 13, 1962 to Guyer; commonly assigned 3,576,243 issued Apr. 27, 1971 to Trunick; and 4,458,810 issued Jul. 10, 1984 to Mahoney.

Over time, the desire for increased convenience led to sequential or "pop-up" dispensers. In a "pop-up" dispenser, a tissue usually extends through the dispensing opening to an elevation above that of the dispenser package. The user simply grasps the exposed portion of the tissue, without the necessity of inserting fingers through the dispensing opening. In pop-up dispensing, each tissue has a leading portion which is first to pass through the dispensing opening, and a trailing portion which later passes through the dispensing opening. Typically the trailing portion of a first tissue to be dispensed overlaps the leading portion of the next tissue to be dispensed. The overlap is measured generally parallel to the direction of withdrawal of the tissues through the dispensing opening. The overlap is usually, but not necessarily, the same for each tissue and constant throughout the width of each tissue. As the first tissue is withdrawn by the user, the leading portion of the next tissue is pulled through the opening, for later dispensing.

Typically the sequential withdrawal of the succeeding tissue through the dispensing opening occurs due to interfolding of adjacent tissues. The tissues are is folded against one another in a variety of configurations, so that the friction of the trailing portion of the withdrawn sheet against the succeeding sheet pulls the leading portion of the succeeding sheet through the dispensing opening. Examples of various interfolding arrangements are found in U.S. Pat. Nos. 3,007,605 issued Nov. 7, 1961 to Donovan; 3,172,563 issued Mar. 9, 1965 to Harwood; 3,679,094 and 3,679,095 both issued Jul. 25, 1972 to Nissen et al.; commonly assigned 3,881,632 issued May 6, 1975 to Early et al; 4,859,518 issued Aug. 22, 1989 to Schutz; and 5,118,554 issued Jun. 9, 1992 to Chan et al.

However, apparatuses for interfolding are both complex and expensive. Purchasing the apparatus represents a significant capital outlay which is ultimately passed on to the consumer of the interfolded tissues. Even when interfolding is properly accomplished, the tissue to be dispensed frequently falls back through the dispensing opening. This problem is exacerbated with relatively tall dispensing packages which are often consumer preferred for economy sized packages. The usable height of the dispensing package is often limited to the length of the overlap of the interfolded tissues. This limitation occurs due to the leading and trailing portions of adjacent tissues unfold inside a package taller than the overlap, then the second tissue falls back into the package.

Potential solutions to the fallback problem result in additional expenses when trying to dispense interfolded tissues. For example, the prior art has suggested outlining the dispensing opening, to prevent improper dispensing. Yet other attempts in the art have disposed adhesive on the film outlining the dispensing opening. Still further attempts in the art replace the film with paper, for environmental reasons. Of course, such film, adhesive, and paper all represent yet additional costs which are passed on to the consumer of the interfolded tissues. Examples of such attempts in the art are U.S. Pat. Nos. 3,007,605 issued Nov. 7, 1961 to Donovan; 3,239,097 issued Mar. 8, 1966 to Bates et al.; 4,200,200 issued Apr. 29, 1980 to Hein, III et al.; 4,681,240 issued Jul. 21, 1987 to Wyant; and 5,316,177 issued May 31, 1994 to Boldt.

Attempts to improve pop-up dispensing packages also include attachment of the tissues to the removable top of the box, so that the first tissue is pulled through the dispensing opening when the box is opened. Still another attempt in the art provides a lapping flap which allegedly holds partially dispensed sheets against falling back into the carton. A commercially successful improvement is the dual mode dispensing package which allows for either pop-up or reach-in dispensing. Examples of such attempts in the art include U.S. Pat. Nos. 2,890,791 issued Jun. 16, 1959 to Wenzel; 4,574,952 issued Mar. 11, 1986 to Masui; and commonly assigned 4,623,074 issued Nov. 18, 1986 to Dearwester.

Yet another attempt in the art describes a continuous strip of adjacent tissues connected at the opposite comers. This arrangement obviated the need for interleaving, but required expensive and unusual manufacturing processes dictating high cost and, moreover, entailed high scrap levels. Such an attempt is found in U.S. Pat. No. 2,823,089 issued Feb. 11, 1958 to De Franco.

Other art areas, not analogous to tissues, have tried other approaches to overcome the disadvantages of interleaving. For example, one attempt in the art uses a dispensing package having non-interleaved sheets, but requires an arcuate friction surface inside the dispensing package. This arrangement may be suitable for refillable dispensing packages. However, the consumer of disposable tissues is unwilling to pay this expense. Yet other attempts in this art further require a biasing means, such as a metal spring, to urge the sheets towards the dispensing opening. Of course, a metal spring is not cost justified with a disposable dispensing package, as is necessary to be used in combination with facial tissues.

Yet other attempts in the art require a weighted member to contact the top of the sheets to be dispensed. Of course, even if the weighted member could be cost justified, the inconvenience to the consumer who places tissues in the automobile, etc. would be a great inconvenience. Examples of such attempts in the art are found in U.S. Pat. Nos. 4,653,666 issued Mar. 31, 1987 to Mertens; 4,768,810 issued Sep. 6, 1988 to Mertens; 4,993,590 issued Feb. 19, 1991 to Windorski; 5,050,909 issued Sep. 24, 1991 to Mertens et al.; and 5,067,628 issued Nov. 26, 1991 to Evenson.

It is apparent there is a need in the art for a lightweight, portable and inexpensive tissue package which provides the convenience of pop-up dispensing. The tissue package must be disposable. It is further apparent there is a need in the art to provide such a tissue package which does not require interfolding of the tissues.

SUMMARY OF THE INVENTION

The invention comprises a tissue package. The tissue package comprises a dispensing package and tissues in combination. The dispensing package has a dispensing opening therein. The dispensing opening is of a first size. A plurality of discrete tissues are sequentially disposed in the dispensing package in a pattern which may non-interleaved. Each tissue is of a predetermined second size, which is greater than the first size of the dispensing opening. Each tissue is constricted upon withdrawal through the dispensing opening. Each tissue is further releasably attached to an adjacent tissue. A first tissue, upon withdrawal through the dispensing opening, pulls the subsequent adjacent second tissue through the dispensing opening. The first and second tissues are easily separated after at least a portion of the first tissue is withdrawn through the dispensing opening.

DETAILED DESCRIPTION OF THE INVENTION

Figure 1A:
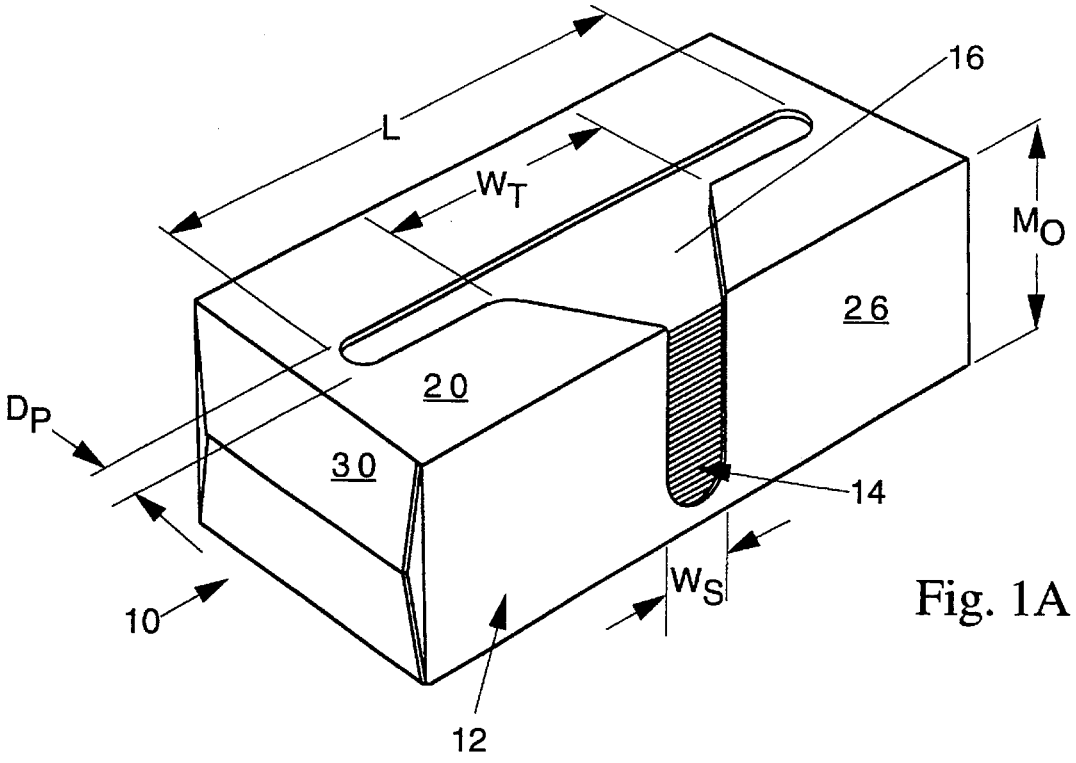
FIG. 1A is a perspective view of a dispensing package and tissues according to the present invention as received by the consumer following removal of any tear strip which exposes the tissues.
Figure 1B:
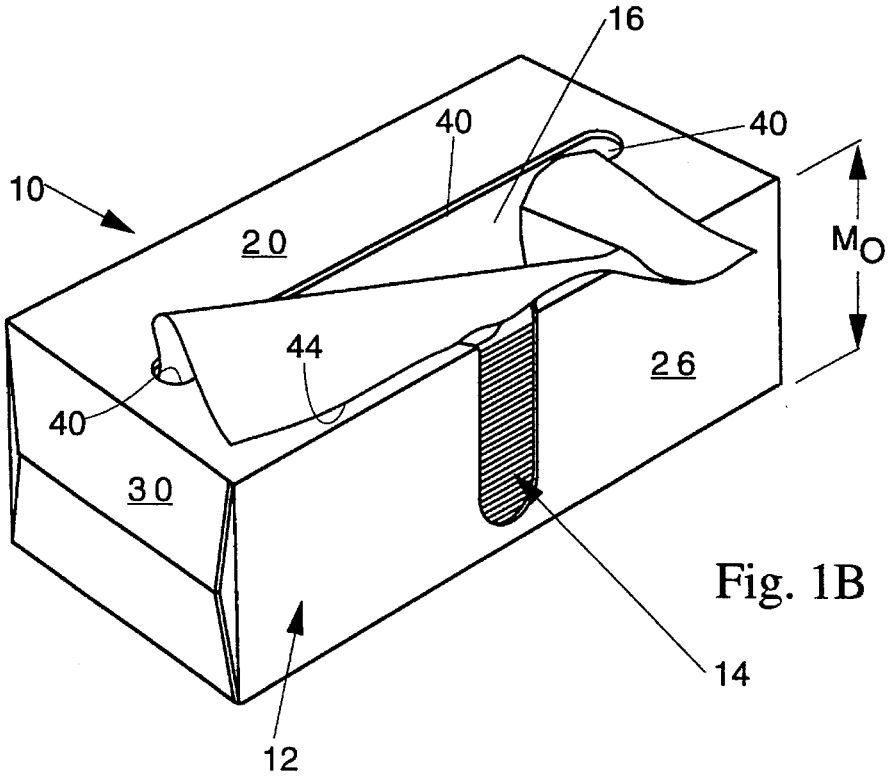
FIG. 1B is the tissue package of FIG. 1A in the pop-up dispensing mode.

Referring to FIGS. 1A and 1B, the tissue package 10 according to the present invention comprises a dispensing package 12 and tissues 14 in combination. The dispensing package 12 has walls, is generally parallelepipedly shaped, and has a dispensing opening 16 therein. A plurality of discrete tissues 14 are disposed in the dispensing package 12. The tissues 14 are not interleaved, and are releasably attached to adjacent tissues 14.

Examining the dispensing package 12 in more detail, it may have separate walls. The walls preferably define a top 20, a bottom, front and back sides 26, and left and right sides 30. Preferably the dispensing opening 16 intercepts both the top wall 20 and one of the other walls 26, 30 of the dispensing package 12, so that the tissues 14 may be dispensed in either a pop-up manner or a reach-in manner as described above. The dispensing opening 16 is preferably tapered within the plane of the top wall 20 of the dispensing package 12 as shown. The taper provides proper resistance as the tissues 14 are withdrawn. A suitable dispensing package 12 may be made in accordance with the teachings of commonly assigned U.S. Pat. No. 4,623,074 issued Nov. 18, 1986 to Dearwester.

The tissue package 10 according to the present invention can be either disposable or refillable. By "disposable" is meant the dispensing package 12 is intended to be discarded after the plurality of tissues 14 supplied therewith is depleted. The dispensing package 12 is not intended to be restocked with tissues 14. Likewise, each tissue 14 is discarded after use, and is not laundered, or otherwise restored. By "refillable" it is meant the dispensing package 12 is or may be restocked with tissues 14 after the supply is depleted.

The tissue package 10 is also lightweight. By "lightweight" it is meant the dispensing package 12 is conveniently portable and does not have dead weight specifically added thereto.

The dispensing opening 16 is of a first size relative to the tissues 14. This first size is designed to constrict the tissues 14 as they are pulled through the dispensing opening 16 by the user. Tissues 14 are considered to be "constricted" when they must touch one or more of the walls 20, 26 intercepted by the dispensing opening 16 upon withdrawal by the user.

If the dispensing opening 16 of FIG. 1A is selected, it may have a width Ws on the sidewall of about 32 millimeters, enlarges to a width Wt of 83 millimeters at the widest point of the taper, and have an overall length L of 150 millimeters in the top 20, and have a dimension perpendicular Dp to this overall length L of 35 millimeters in the area which is not intercepted by the taper. The foregoing size of dispensing opening 16 is suitable for a dispensing package 12 measuring 227 by 110 by 106 millimeters in length, width, and height, respectively. The tissues 14 can have length, width, and footprint dimensions approaching that of the inside of the dispensing package 12.

Examining the tissues 14 in more detail, the tissues 14 comprise a plurality of discrete sheets. As used herein, tissues 14 are considered to be "discrete" if they are separate from other tissues 14 prior to being releasably attached thereto as described below.

Each tissue 14 is of a second size. This second size is greater in at least one dimension than the first size of the dispensing opening 16 of the dispensing package 12. Of course, both the dispensing opening 16 and the tissues 14 may have a variety of shapes, each with several dimensions. These dimensions may or may not be equal to other dimensions of the tissues 14 or dispensing opening 16 (as in the ordinary case of a rectangular tissue 14 having two long sides and two short sides). In the example of FIGS. 1A and 1B, the tissues 14 are considered to be of greater size than the dispensing opening 16 when the tissue 14 is constricted upon withdrawal through the dispensing opening 16 in the normal course of dispensing by the user. Note that only one dimension of the tissue 14 has to be greater than the corresponding dimension of the dispensing opening 16 for constriction to occur and the tissue 14 to be considered to have a greater size than the dispensing opening 16.

The tissues 14 are preferably generally rectangularly shaped ranging in size from about 175 to 250 millimeters per side, although both larger and smaller sizes work well with the present invention. The longer side of the tissues 14 is generally parallel the longer dimension of the dispensing package 12.

Suitable tissues 14 may be made according to commonly assigned U.S. Pat. No. 4,191,609 issued Mar. 4, 1980 to Trokhan, or U.S. Pat. No. 5,332,118 issued Jul. 26, 1994 to Muckenfuhs, the disclosures of which are incorporated herein by reference for the purpose of showing how to make tissues 14 suitable for use with the present invention.

The tissues 14 are disposed in a dispensing package 12 in a non-interleaved pattern. As used herein, a pattern is considered to be "non-interleaved" when no part of a tissue 14 is below the succeeding tissue 14 to be dispensed while the tissues 14 are disposed in the pattern prior to dispensing through an upwardly oriented dispensing opening 16. Thus, in the non-interleaved disposition of tissues 14 according to the present invention, pop-up dispensing does not rely upon frictional engagement between adjacent tissues 14. Adjacent tissues 14 are releasably attached to each other, so that a first tissue 14 and a second tissue 14 are easily separated after the first tissue 14 is withdrawn through the dispensing opening 16. Tissues 14 are considered to be "easily separable" when they can be quickly detached from one another without gross, unintended deformation or tearing of either tissue 14. Tissues 14 are considered "adjacent" which are consecutively dispensed from the dispensing package 12, by either pop-up or reach-in dispensing as described above.

FIG. 1B shows the tissues 14 in the dispensing sequence. The tissue 14 is considered to have been dispensed "through" the dispensing opening 16 when it passes at least partially from inside the dispensing package 12 to outside the dispensing package 12, either due to the consumer reaching in and grasping the tissue 14, or the tissue 14 popping up through the dispensing opening 16, in either case by trailing the tissue 14 previously withdrawn by the user. A tissue 14 is considered to be "withdrawn" after it has passed completely from inside the dispensing opening 16 to outside the dispensing opening 16, and no portion or edge is of the tissue 14 remains within the dispensing package 12.

Referring to FIGS. 3A–3E, each tissue 14 is releasably attached to both adjacent tissues 14 by any releasable attachment means which allows easy separation to occur as the tissue 14 is being dispensed or after the tissue 14 is withdrawn through the dispensing opening 16. The releasable attachment means may comprise adhesively joining the tissue 14 to the adjacent tissues 14 with skin friendly adhesive. A suitable adhesive is supplied by Findley Adhesives Inc. of Wauwatosa, Wis. as Item No. H9087-05. "Releasable attachment means" allow easy separation of adjacent tissues 14, but do not include friction, cohesion, or other forces which do not releasably attach adjacent tissues 14 without an affirmative step during manufacturing.

The adhesive may be lightly applied to the tissues 14, at a location X juxtaposed with the edges of the tissue 14 which are parallel to the major axis of and may be centrally disposed relative to the dispensing opening 16. Preferably, these are the leading edge 44 and trailing edge of the tissue 14 as it is withdrawn through the dispensing opening 16. Preferably, the adhesive does not extend throughout the entire width of the tissue 14, to prevent the tissues 14 from being difficult to separate after withdrawal through the dispensing opening 16.

Alternatively, the adhesive may be juxtaposed with the corners of the tissue 14, preferably the two corners of the leading edge 44 and trailing edge. This arrangement provides the advantage over the aforementioned centrally bonded arrangement of more flexibility in the placement of the adhesive. In either arrangement, the lap or fin seal 15, 15' comprises both bonded areas and free areas. Having both bonded areas and free areas in the lap seal 15 is important for controlling the separation forces and how the leading edge 44 of the tissue 14 is exposed before separation from the succeeding tissue 14.

Figure 2A:
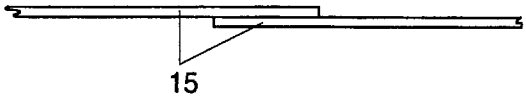
FIG. 2A is a side elevational view of a lap seal.
Figure 2B:
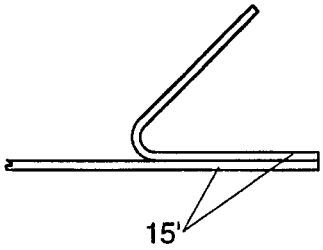
FIG. 2B is a side elevational view of a fin seal.

Each tissue 14 may be releasably attached to an adjacent tissue 14 at a lap seal 15 or a fin seal 15'. The separation forces typically applied during dispensing to a lap seal 15, as illustrated by FIG. 2A are in shear. The separation forces typically applied during dispensing to a fin seal 15', as illustrated by FIG. 2B are in peel. It will be apparent to one skilled in the art that the seal joining adjacent tissues 14 must be strong enough to pull the succeeding tissue 14 through the dispensing opening 16, yet allow the tissues 14 to be easily separable.

Preferably, each tissue 14 is joined to the adjacent tissues 14 at a fin seal 15' as illustrated in FIG. 2B. A fin seal 15' has the advantage over the lap seal 15 of FIG. 2A that the separation force between the tissues 14 attached by a fin seal 15' is are generally less than in a similar lap seal 15, making the tissues 14 more easily separable. This advantage is particularly noticeable when the tissues 14 are acqueously wetted, or otherwise have relatively high cohesion to the adjacent tissue 14.

Figure 3A:
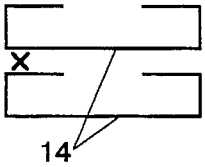
FIG. 3A is a side elevational schematic view of C-folded tissues.

In order to accomplish the lap seal 15 according to the present invention, the plurality of discrete tissues 14 may be disposed inside the package in a C-folded pattern as shown in FIG. 3A. A C-folded pattern has the benefits when used in conjunction with the present invention of presenting an edge at the top of the stack of tissues 14 by which the consumer can use to pull the first tissue 14 through the dispensing opening 16.

Figure 3B:
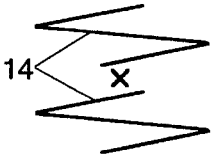
FIG. 3B is a side elevational schematic view of unidirectionally oriented Z-folded tissues.

Alternatively, in order to accomplish the lap seal 15 according to the present invention, the plurality of discrete tissues 14 may be disposed inside the package in a unidirectionally oriented Z-folded pattern as shown in FIG. 3B. A unidirectionally oriented Z-folded pattern has the benefit when used in conjunction with the present invention of disposing the leading edge of the tissue 14 in the center of the dispensing package 12. This arrangement allows the first tissue 14 to be easily grasped by the user.

Figure 3C:
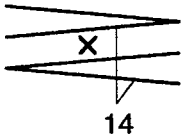
FIG. 3C is a side elevational schematic view of alternating V-folded tissues.

Alternatively, in order to accomplish the lap seal 15 according to the present invention, the plurality of discrete tissues 14 may be disposed inside the package in an alternating V-folded pattern as shown in FIG. 3C. An alternating V-folded pattern has the benefits when used in conjunction with the present invention of yielding a uniformly level stack of tissues 14.

Figure 3D:
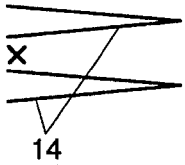
FIG. 3D is a side elevational schematic view of unidirectionally oriented V-folded tissues.
Figure 3E:
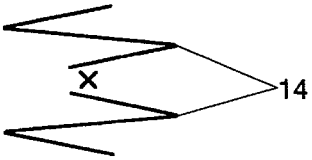
FIG. 3E is a side elevational schematic view of alternating Z-folded tissues.

Alternatively, in order to accomplish the fin seal 15' according to the present invention, the plurality of discrete tissues 14 may be disposed inside the package in a unidirectionally oriented V-folded pattern as shown in FIG. 3D. A unidirectionally oriented V-folded pattern has the benefits when used in conjunction with the present invention of being a simple fold pattern that efficiently uses the space in the dispensing package 12. Also, this fold pattern can align the folded edges of the tissues 14 with the major dimension of the dispensing opening 16 such that the folded edges are oriented proximate to the sidewall 26 portion of the dispensing opening 16. This arrangement also reduces occurrences of the user grasping only one-half of the tissue 14 during reach-in dispensing.

Another way to accomplish a fin seal 15' according to the present invention is the alternating Z-fold pattern of FIG.

3E. An alternating Z-fold pattern has the benefit when used in conjunction with the present invention of centering the leading edge of the tissue 14 while still employing a fin seal 15'.

If an adhesive releasable attachment means is not desired to join adjacent tissues 14 in order to save material costs, other releasable attachment means may be utilized. In particular, fusion bonded releasable attachment means, such as ultrasonic welding or heat sealing of adjacent tissues 14 may be employed, as is well known by one skilled in the art. Additionally, mechanical entanglement releasable attachment means, such as needle punching, steam sealing, embossing, or crimping may be utilized with the present invention as is well known by one skilled in the art. Finally, autogeneous bonding releasable attachment means, such as are disclosed in commonly assigned U.S. Pat. No. 4,854,984 issued Aug. 8, 1989 to Ball et al. may be utilized.

It will be readily apparent to one skilled in the art that many variations are feasible. For example, the tissues 14 may be wetted with a solution. Suitable wetting solutions are disclosed in the aforementioned U.S. Pat. No. 5,332,118 issued to Muckenfuhs, which patent is incorporated herein by reference. Wetting enables the tissues 14 to be used for wiping the skin as, for example, upon removal of a soiled diaper, sanitary napkin, or other type of undergarment, or to remove soiling from a hard surface (such as a countertop).

It will further be apparent to one skilled in the art that wetted tissues 14 may be releasably attached to one another through cohesion at the overlap between adjacent tissues 14. The cohesion does not require an affirmative manufacturing step and may be used to augment the adhesive, fusion bonding, and mechanical releasable attachment means specified above.

The dispensing package 12 of FIGS. 1A–1B may have a dispensing opening 16 which comprises any variety of shapes, and intercepts only one wall of the dispensing package 12 or, intercepts more than two walls of the dispensing package 12. The rigid wall dispensing package 12 may have a major depth $M_D$ measured perpendicular to the major wall 20 intercepted by the dispensing opening 16. The major depth $M_D$ of the dispensing package 12 is often vertical because the dispensing opening 16 is typically on the upper surface of the dispensing package 12 when the dispensing package 12 is placed on a horizontal surface or reference plane (such as a table or countertop). Surprisingly, the tissue package 10, utilizing releasably attached adjacent tissues 14, is able to be used in conjunction with a dispensing package 12 having a major depth $M_D$ greater than the overlap between adjacent tissues 14. More surprisingly, this can be accomplished without even requiring the tissue 14 to be disposed in an interleaved pattern.

The walls of the dispensing package 12 need not be freestanding and rigid as depicted, but instead may be flaccid or resiliently deformable. This arrangement may provide a dispensing package 12 with an amorphous shape. Material, such as polyethylene film, is suitable if flaccid walls are selected for the dispensing package 12. Additionally, the tissues 14 may be releasably attached by means which are compatible with an interleaved pattern, so that the releasably attached tissues 14 may be disposed in an interleaved pattern within the dispensing package 12 or wound onto a roll. In yet another variation, the tissues 14 may be interleaved into clips having a predetermined number of tissues 14. Then, to combine multiple clips into a single dispensing package 12, the first and last tissues 14 of adjacent clips may be releasably attached as described above. All of these variations are within the scope and intent of the appended claims.

What is claimed is:

1. A tissue package comprising a dispensing package and tissues in combination, said tissue package comprising:

a lightweight dispensing package having a dispensing opening therein, said dispensing opening being of a first size; and a plurality of discrete tissues sequentially disposed in said dispensing package, said plurality of tissues being in a non-interleaved pattern, each said tissue being of a predetermined second size, said second size being greater in at least one dimension than said first size of said dispensing opening whereby each said tissue is constricted upon withdrawal through said dispensing opening, each said tissue further being releasably attached directly to an adjacent tissue, whereby a first tissue, upon withdrawal through said dispensing opening, pulls a subsequent adjacent second tissue through said dispensing opening, said first tissue and said second tissue being easily separable after at least a portion of said first tissue is withdrawn through said dispensing opening.

2. A tissue package comprising a dispensing package and tissues in combination, said tissue package comprising:

a lightweight disposable dispensing package having a dispensing opening therein, said dispensing opening being of a first size; and a plurality of discrete tissues sequentially disposed in said dispensing package, said plurality of tissues being in a pattern, each said tissue being of a predetermined second size, said second size being greater in at least one dimension than said first size of said dispensing opening whereby each said tissue is constricted upon withdrawal through said dispensing opening, each said tissue further overlapping and being releasably attached directly to an adjacent tissue, whereby a first tissue, upon withdrawal through said dispensing opening, pulls a subsequent adjacent second tissue through said dispensing opening, said first tissue and said second tissue being easily separable after at least a portion of said first tissue is withdrawn through said dispensing opening.

3. A tissue package comprising a dispensing package and tissues in combination, said tissue package comprising:

a lightweight rigid wall dispensing package having a dispensing opening therein, said dispensing opening being of a first size, and intercepting at least one wall of said dispensing package, said dispensing package having a major depth measured perpendicular to said at least one wall intercepted by said dispensing opening; and a plurality of discrete tissues sequentially disposed in said dispensing package, said plurality of tissues being disposed in a pattern, each tissue being of a predetermined second size, said second size being greater in at least one dimension than said first size of said dispensing opening whereby each said tissue is constricted upon withdrawal through said dispensing opening, each said tissue further directly contacting and overlapping an adjacent tissue at an overlap, wherein adjacent tissues are releasably attached at said overlap by adhesive, said overlap being measured generally parallel the direction of withdrawal through said dispensing opening when said tissues are dispensed, whereby a first tissue, upon withdrawal through said dispensing opening, pulls a subsequent adjacent tissue through said dispensing opening, said first tissue and said second tissue being easily separable after at least a portion of said first tissue is withdrawn through said dispensing opening, said overlap being less than said major depth of said dispensing package.

4. A tissue package according to claim 1 or 2 wherein said adjacent tissues are releasably attached by an adhesive.

5. A tissue package according to claims 1 or 2 wherein said first tissue and said second tissue are releasably attached at a fin seal.

6. A tissue package according to claims 1 or 2 wherein said first tissue and said second tissue are releasably attached at a lap seal.

7. A tissue package according to claim 3 wherein adjacent tissues are releasably attached at a fin seal.

8. A tissue package according to claim 3 wherein adjacent tissues are releasably attached at a lap seal.

9. A tissue package according to claim 1 or 2 wherein said dispensing package has discrete, rigid walls.

10. A tissue package according to claim 1 or 2 wherein said dispensing package has flaccid walls.

11. A tissue package according to claim 5 wherein said fin seal comprises both bonded areas and free areas.

12. A tissue package according to claim 3 wherein said dispensing package is generally parallelepipedly shaped having six walls, and said dispensing opening intercepts more than one of said walls.

* * * * *